US009210760B2

(12) United States Patent
Sanders et al.

(10) Patent No.: US 9,210,760 B2
(45) Date of Patent: Dec. 8, 2015

(54) ENHANCEMENTS FOR LED LAMPS FOR USE IN LUMINAIRES

(71) Applicant: ABL IP Holding LLC, Conyers, GA (US)

(72) Inventors: Chad N. Sanders, Ashburn, VA (US); Steven S. Lyons, Herndon, VA (US)

(73) Assignee: ABL IP HOLDING LLC, Conyers, GA (US)

( * ) Notice: Subject to any disclaimer, the term of this patent is extended or adjusted under 35 U.S.C. 154(b) by 213 days.

(21) Appl. No.: 13/975,878

(22) Filed: Aug. 26, 2013

(65) Prior Publication Data

US 2015/0054410 A1 Feb. 26, 2015

(51) Int. Cl.
*H01J 7/44* (2006.01)
*H05B 33/08* (2006.01)

(52) U.S. Cl.
CPC ..... *H05B 33/0866* (2013.01); *H05B 33/0857* (2013.01); *H01J 7/44* (2013.01)

(58) Field of Classification Search
CPC ..... H01J 1/62; H01J 7/24; H01J 7/44
USPC ..... 315/51
See application file for complete search history.

(56) References Cited

U.S. PATENT DOCUMENTS

| | | | | |
|---|---|---|---|---|
| 8,212,469 | B2 | 7/2012 | Rains, Jr. et al. | |
| 2010/0225251 | A1* | 9/2010 | Maruyama | 315/307 |
| 2010/0308739 | A1* | 12/2010 | Shteynberg et al. | 315/193 |
| 2011/0175528 | A1 | 7/2011 | Rains, Jr. et al. | |
| 2011/0176291 | A1 | 7/2011 | Sanders et al. | |
| 2011/0176316 | A1 | 7/2011 | Phipps et al. | |

* cited by examiner

*Primary Examiner* — John Poos
(74) *Attorney, Agent, or Firm* — RatnerPrestia

(57) ABSTRACT

One example solid state lighting type lamp for a three-way luminaire includes a power source, a controller, an output stage, switching logic circuitry and multiple sets of light emitters. The logic circuitry receives input signals from tip and ring power contacts on a lamp base. The controller provides power from the power source to the output stage which is controlled by the switch logic circuitry to selectively apply power to different ones of the sets of light emitters responsive to the input signals. Each set of light emitters emit light having different color temperatures. In another three-way luminaire example, the control circuitry is configured to control drive current in a sequence to toggle the lamp consecutively between an OFF state and ON state in response to inputs from a three-way socket. Another type of lamp includes circuitry to permanently disable the lamp on detection of an end-of-life condition.

22 Claims, 6 Drawing Sheets

ENHANCEMENTS FOR LED LAMPS FOR USE IN LUMINAIRES

TECHNICAL FIELD

The present subject matter relates to lamps for general lighting applications that utilize solid state light emitting sources and in particular to a solid state lamp for a three-way luminaire. The present subject matter also concerns apparatus and methods for disabling a solid state lamp at the end of its useful lifetime.

BACKGROUND

It has been recognized that incandescent lamps are a relatively inefficient light source. However, after more than a century of development and usage, they are cheap. Also, the public is quite familiar with the form factors and light output characteristics of such lamps. Fluorescent lamps have long been a more efficient alternative to incandescent lamps. For many years, fluorescent lamps were most commonly used in commercial settings. However, recently, compact fluorescent lamps have been developed as replacements for incandescent lamps. While more efficient than incandescent lamps, compact fluorescent lamps also have some drawbacks. For example, compact fluorescent lamps utilize mercury vapor and represent an environmental hazard if broken or at time of disposal. Cheaper versions of compact fluorescent lamps also do not provide as desirable a color characteristic of light output as traditional incandescent lamps and often differ extensively from traditional lamp form factors.

Recent years have seen a rapid expansion in the performance of solid state light emitting sources such as light emitting devices (LEDs). With improved performance, there has been an attendant expansion in the variety of applications for such devices. For example, rapid improvements in semiconductors and related manufacturing technologies are driving a trend in the lighting industry toward the use of light emitting diodes (LEDs), organic light emitting diodes (OLEDs) or other solid state light sources in lamps for general lighting applications. These lamps meet the need for more efficient lighting technologies and address ever increasing costs of energy along with concerns about global warming due to consumption of fossil fuels to generate energy. LED solutions also are more environmentally friendly than competing technologies, such as compact fluorescent lamps, for replacements for traditional incandescent lamps. Hence, there are now a variety of products on the market and a wide range of published proposals for various types of lamps using solid state light emitting sources, as lamp replacement alternatives.

Incandescent lamps are manufactured in many form factors and electrical configurations. For example, the base of an incandescent lamp may be configured as a one-way lamp or a three way lamp.

FIG. 1 illustrates an example of a solid state lamp 30. The exemplary lamp 30 may be utilized in a variety of lighting applications analogous to applications for common incandescent lamps and/or compact fluorescent lamps. The lamp 30 includes solid state light emitters 32 for producing lamp output light of a desired characteristic, from the emitter outputs and/or from luminescent phosphor emissions driven by the emitter outputs as discussed more fully below. The solid state emitters as well as the other components within the bulb 31 are visible through the cut-out window view of FIG. 1.

At a high level, a lamp 30, includes solid state light emitters 32, a bulb 31, an industry standard base 35 and a housing 33. The housing 33 extends into an interior of the bulb 31 and supports the bulb, the solid state light emitters 32 and a circuit board including electronic components of the lamp. In the examples, the orientations of the solid state light emitters 32 produce emissions through the bulb 31 that approximate light source emissions from a filament of an incandescent lamp. The illustrated example also uses an optional inner optical processing member 34, of a material that is at least partially light transmissive. The member 34 is positioned radially and longitudinally around the solid state light emitters 32 supported on the housing 33 and between an inner surface of the bulb 31 and the solid state light emitters 32. The bulb and/or the inner member may be transparent or diffusely transmissive. If provided, phosphors may be deployed on the inner optical processing member 34 or on the bulb 31. Lamp 30 also includes heat sink fins 36 which dissipate heat from the solid state light emitters 32.

FIG. 1A is a plan view of a screw type lamp base, such as an Edison base or a candelabra base. For many lamp applications, the existing lamp socket provides two electrical connections for AC main power. The lamp base in turn is configured to mate with those electrical connections. As shown, the base 60 has a center contact tip 61 for connection to one of the AC main lines. The threaded screw section of the base 60 is formed of metal and provides a second outer AC contact at 62, sometimes referred to as neutral or ground because it is the outer casing element. The tip 61 and screw thread contact 62 are separated by an insulator region (shown in gray). When power is applied to the tip connection, a circuit is formed from the tip connection 61 through the light emitter to the outer AC contact 62. This base is for a one-way lamp that is either on or off.

FIG. 2 is a plan view of an industry standard three-way dimming screw type lamp base, such as for a three-way mogul lamp base or a three-way medium lamp base. Although other base configurations are possible, the example is that for a screw-in base 63 as might be used in a three-way mogul lamp or a three-way medium lamp base. As shown, the base 63 has a center contact tip 64 for a low power connection to one of the AC main lines. The three-way base 63 also has a lamp socket ring connector 65 separated from the tip 64 by an insulator region (shown in gray). A threaded screw section of the base 63 is formed of metal and provides a second outer AC contact at 66, sometimes referred to as neutral or ground because it is the outer casing element. The socket ring connector 65 and the screw thread contact 66 are separated by an insulator region (shown in gray). A conventional incandescent lamp having the base shown in FIG. 2, has two filaments. The first filament is connected between the tip contact 64 and the outer AC contact 66 and a second filament is connected between the ring contact 65 and the outer AC contact 66. The luminaire for this type of lamp sequentially applies power to the ring contact 65, tip contact 64 and to both the tip and ring contacts. The filament between the tip contact 64 and the outer AC contact 66 typically produces light having a higher lumen level than the filament between the ring contact 65 and the outer AC contact 66. Thus, as the luminaire is cycled, light having three different lumen levels is produced.

Another attribute of incandescent lamps is their lifetime. At the end of its life, an incandescent lamp typically "burns out" when its filament breaks. A solid-state lamp, however, typically does not fail abruptly but exhibits increasingly degraded performance as it ages.

To be accepted by the public, it is desirable that LED lamps to conform to the form factors, electrical configurations and/or the end of life performance of incandescent lamps.

SUMMARY

The teachings herein provide further improvements over existing lamp technologies. A three-way lamp example is configured to produce light from different sets of light emitters, one for each of the three electrical connections made by the luminaire. In another example, a lamp is configured to operate as a one-way lamp even when inserted in a three-way socket. In yet another example, a lamp is monitored for indications that it is approaching the end of its useful life and, when one or more of these indications crosses a threshold, the lamp is disabled, simulating an abrupt failure.

In the first example, a three-way lamp includes a power source, a controller, an output stage, switching logic circuitry and at least one set of light emitters. The logic circuitry is coupled to the power source to receive signals from the tip and ring contacts. The controller is coupled to provide power from the power source to the output stage and the output stage is coupled to the switch logic circuitry to selectively apply power to the light emitters responsive to the signals from the tip and ring contacts.

According to one aspect of this example, the at least one set of light emitters includes three sets of light emitters that are configured to emit light having respectively different color temperatures and the logic circuitry is configured to activate respectively different ones of the three sets of light emitters for each of three active states of the signals provided by the tip and ring contacts.

According to another aspect of this first example, the three sets of light emitters each has a respectively different number of light emitters.

According to yet another aspect of this first example, at least one of the three sets of light emitters is configured to produce light in a different color than the other two sets of light emitters.

According to still another aspect of this example, the at least one set of light emitters includes a single set of light emitters and the logic circuitry is configured to cause the controller to apply power to the light emitters responsive to a signal on the ring contact and on the tip and ring contacts and not to apply power to the light emitters responsive to a signal only on the tip contact so that the single set of light emitters cycles on and off responsive to changing switch positions of a three-way switch.

According to another example, a lamp includes a power source, a controller, an output stage, at least one set of light emitters and status monitoring circuitry, coupled to the controller, that monitors the status of the light emitters. The controller is coupled to provide power from the power source to the output stage and is coupled to the status monitoring circuitry to apply power to the light emitters as long as the status monitoring circuitry determines that the light emitters are within their useful lifetime. The status monitoring circuitry provides a non-volatile signal enabling the controller. When the status monitoring circuitry determines that the light emitters are no longer within their useful lifetime, it switches the non-volatile signal to disable the controller.

According to one aspect of this example, the status monitoring circuitry measures an amount of time that the light emitters emit light and disables the controller when this amount of time exceeds a threshold value.

According to another aspect of this example, the status monitoring circuitry measures a lumen level of the light provided by the light emitters and disables the controller when the measured lumen level is less than a threshold value.

According to yet another aspect of this example, the status monitoring circuitry measures a temperature of the light emitters and disables the controller when the measured temperature is greater than a threshold value.

Additional advantages and novel features of the examples will be set forth in part in the description which follows, and in part will become apparent to those skilled in the art upon examination of the following and the accompanying drawings or may be learned by production or operation of the examples. The objects and advantages of the present subject matter may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

Figure 1:
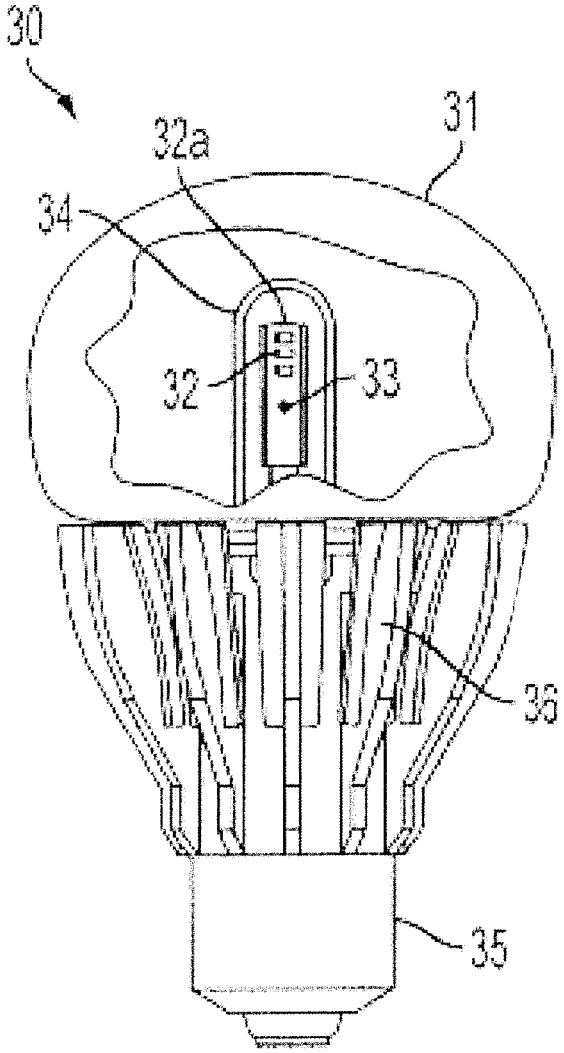
Fig. 1 Prior Art
FIG. 1 (prior art) is a plan view of a solid state lamp.
Figure 1A:
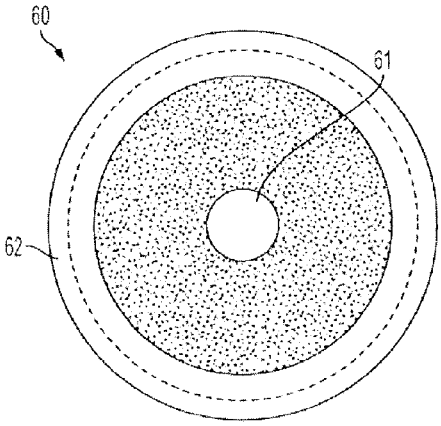
Fig. 1A Prior Art
FIG. 1A (prior art) is a plan view of a one-way lamp base.
Figure 2:
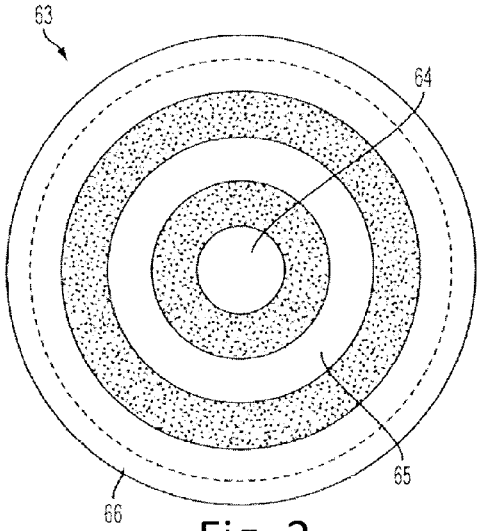
Fig. 2 Prior Art
FIG. 2 (prior art) is a plan view of a three-way lamp base.

The various examples disclosed herein relate to solid state lamp assemblies that mimic and extend the functionality of corresponding incandescent lamp assemblies. Each of the embodiments described below concerns the electronic components of the lamp assembly. In addition to the described electronic components, each lamp includes a bulb and a housing on which the bulb and the electronic components are mounted and a base, such as shown in FIGS. 1 and 2 through which power signals are provided to the electronic components. The lamp may also include a heat sink to dissipate heat generated by the LEDs, as represented for example by the fins 36.

Reference now is made in detail to the examples illustrated in the accompanying drawings and discussed below. FIG. 3 illustrates an first example three-way lamp 300. The lamp includes tip, ring and neutral (N) lines that connect to the respective tip, ring and outer AC contacts, as shown in FIG. 1. The tip and ring lines are connected to provide AC power to respective power supplies 314 and 316 through fuses 310 and 312. In one implementation, the power supply 314 is a half-bridge rectifier and the power supply 316 is a full-bridge rectifier. The half-bridge rectifier 314 is connected to the full-bridge rectifier 316, as shown in FIG. 3, such the two diodes of the bridge rectifier 316 that are connected to the neutral line are shared between the rectifiers 314 and 316.

Thus, both rectifiers provide a full-wave rectified power signal. It is contemplated that other types of power supplies may be used.

The positive output terminals of the power supplies 314 and 316 are connected to each other as are the negative output terminals. The combined positive and negative output terminals of the power supplies are connected to a filter circuit 318. The combined positive terminals of the power supplies are connected to provide operational power to switch logic circuitry 320. The operational power signal provided by the filter 318 is applied to the controller stage 322, which converts the filtered DC power signal into a power signal having a voltage and current suitable for the LED sets. Controller stage 322 applies this power signal to the output stage 324. The output stage 324 includes driver circuits that provide the power signal to the three sets of light emitters: set A including LEDs 1-N of color A; set B including LEDs 1-N of color B and set C including LEDs 1-N of color C. The output stage includes an output select matrix 326 which switches among the three sets of light emitters under control of the switch logic circuitry 320.

Switch logic circuitry 320 is coupled to receive signal inputs from the tip and ring lines, via the fuses 310 and 312. The switch logic circuitry is also coupled to a source of reference potential (e.g. ground). The circuitry 320 converts the alternating current (AC) power signals provided by the tip and ring lines into logic signals that are applied to the output select matrix 326 of the output stage 324 to control which set of LEDs is activated. In one implementation, the switch logic may employ two opto-isolators that receive the respective AC signals provided by the tip and ring lines as input signals, and produce output signals suitable for driving digital logic circuits in the output select matrix 326. An example opto-isolator circuit is described with reference to FIG. 16 in U.S. Pat. No. 8,212,469 entitled LAMP USING SOLID STATE SOURCE AND DOPED SEMICONDUCTOR NANOPHOSPHOR which is incorporated herein by reference. Alternatively, electromechanical relays may be used in place of the opto-isolators in the switch logic. Other applications describing the operation of lamps having solid-state light emitters include U.S. pub. nos. 2011/0176291, 2011/0176316 and 2011/0175528, which are incorporated herein by reference Table 1 is a truth table showing the logic signals 327 and 328 produced by the switch logic responsive to the tip and ring signals and the resulting light emitter set selected by the output select matrix 326.

TABLE 1

| Tip, Ring | 327 | 328 | Light Emitter |
|---|---|---|---|
| Off, Off | L | L | None |
| Off, On | H | L | Color A |
| On, Off | L | H | Color B |
| On, On | H | H | Color C |

The logic signals output by the switch logic circuitry are described as logic-high (H) and logic-low (L). These designations do not indicate signal levels. For example, if the output select matrix uses negative logic, the voltage value of the H signal may be less than that of the L signal. The output select matrix 326 may be an analog 1 by 4 multiplexer. The operational power signal generated by the output stage 324 may be switched among the sets of LEDs as shown in Table 1.

In one implementation, the three sets of LEDs are of any type rated to emit energy of wavelengths from the blue/green region around 460 nm down into the UV range below 380 nm. In an example lamp, the light emitted by the LEDs is converted into white light by nanophosphors that have absorption spectra with upper limits around 430 nm, although other doped semiconductor nanophosphors may have somewhat higher limits on the wavelength absorption spectra and therefore may be used with LEDs or other solid state devices rated for emitting wavelengths as high as say 460 nm. In the specific examples, particularly those for white light lamp applications, the LEDs are near UV LEDs rated for emission somewhere in the 380-420 nm range, although UV LEDs could be used alone or in combination with near UV LEDs even with the exemplary nanophosphors. A specific example of a near UV LED, used in several of the specific white lamp examples, is rated for 405 nm emission.

The structure of a LED includes a semiconductor light emitting diode chip, within a package or enclosure. A transparent cover (typically formed of glass, plastic or the like), of the package that encloses the chip, allows for emission of the electromagnetic energy in the desired direction. In this implementation, the transparent cover also encloses semiconductor nanophosphors that convert the near UV light emitted by the LEDs into white light.

One or more doped semiconductor nanophosphors are used in the LEDs to convert energy from the source into visible light of one or more wavelengths to produce a desired characteristic of the visible light output of the lamp. In one example, the nanophosphors are selected such that the LEDs in set A produce white light with a color temperature of 2700K, the LEDs in set B set produce white light with a color temperature of 3500K and the LEDs in set C set produce white light with a color temperature of 5000K. The nanophosphors used to produce light in different color temperatures are a blend of single wavelength nanophosphors that produce white light having the desired color temperature.

The nanophosphor materials may be a solid, although liquid or gaseous materials may help to improve the florescent emissions by the nanophosphors in the material. For example, alcohol, oils (synthetic, vegetable, silicon or other oils) or other liquid media may be used. A silicone material, however, may be cured to form a hardened material, at least along the exterior (to possibly serve as an integral container), or to form a solid throughout the intended volume. If hardened silicone is used, however, a glass container still may be used to provide an oxygen barrier to reduce nanophosphor degradation due to exposure to oxygen. If a gas is used, the gaseous material, for example, may be hydrogen gas, any of the inert gases, and possibly some hydrocarbon based gases. Combinations of one or more such types of gases might be used.

While the example implementation uses LEDs providing white light at three different color temperatures, it is contemplated that LEDs providing light of a single color may be used for one or more of the light emitter sets. For example, the three-way lamp may provide a red light, to act as a night-light, if only the ring line is active and provide white light having a first different color temperature when only the tip line is active and having a second color temperature when both the tip and ring lines are active. In this instance, the nanophosphors in the LEDs in set A are selected to emit red light and the nanophosphors in the LEDs in sets B and C are selected to emit white light at the respective color temperatures.

For some lighting applications where a single color is desirable rather than white, the lamp might use a single type of nanophosphor in the material. For a red lamp type application the one nanophosphor would be of a type that produces predominantly red light emission in response to pumping energy from the LEDs. The upper limits of the absorption spectra of the exemplary nanophosphors are all at or around 430 nm, therefore, the LEDs used in such a monochromatic lamp would emit energy in a wavelength range of 430 nm and below.

Alternatively, conventional red LEDs may be used in place of the near UV LEDs and the red nanophosphors. If a red LED is used, however, it may be desirable to use one that produces a relatively bright light, for example a superluminescent LED (SLED). It is contemplated that the LED sets A, B and C, may all be single color sets using either near UV LEDs with a single color phosphor or single color LEDs or SLEDs.

Figure 3A:
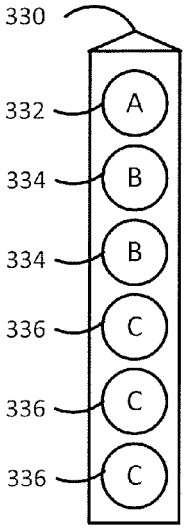
FIGS. 3A and 3B are perspective drawings of example light emitter assemblies suitable for use in the example lamp shown in FIG. 3
Figure 3B:
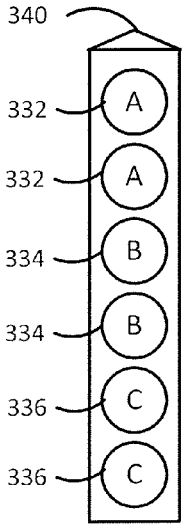
Figure 3:
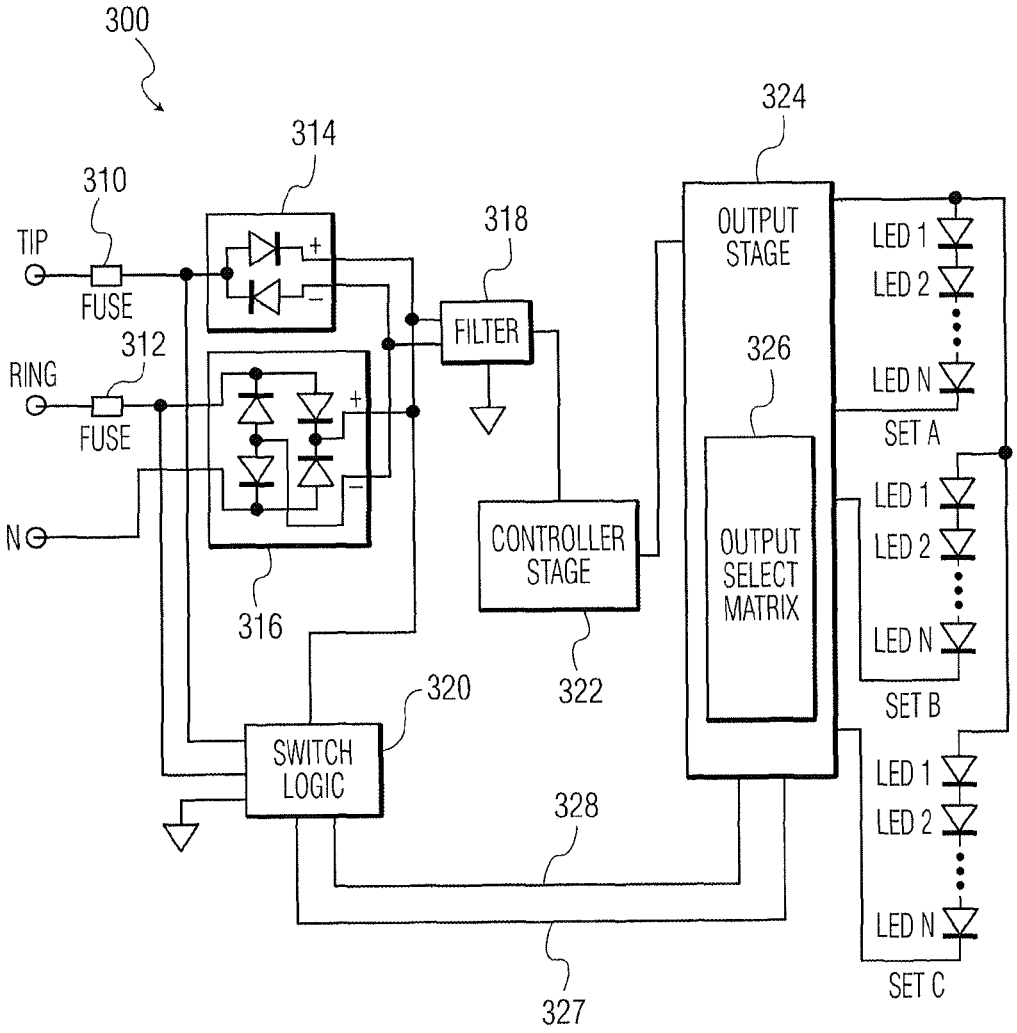
FIG. 3 is a block diagram, partly in schematic diagram form, of a first example lamp.

FIGS. 3A and 3B are perspective drawings illustrating examples of how the LED sets A, B and C may be mounted in the lamp 300. The mounting posts shown in both of these figures have triangular cross-sections. The LEDs in each of the sets A, B and C are mounted on all three sides of the post. For convenience, only one side is shown, the other two sides have the same arrangement although it is contemplated that they may have different arrangements.

The post 330 shown in FIG. 3A has different numbers of LEDs in each of the three sets. In this example, there is one LED 332 from set A, two LEDs 334 from set B and three LEDs 336 from set C. In this configuration, the light intensity of color A will be less than that of color B which, in turn, will be less than that of color C. The relative numbers of LEDs shown in FIG. 3A are illustrative only. It is contemplated that each set may have different numbers of LEDs on each side of the post and that the ratios of the numbers of LEDs in the various sets may be different.

Alternatively, the post 340 shown in FIG. 3B has equal numbers of LEDs from each set. In this example, each side of the post 340 has two LEDs 332 from set A, two LEDs 334 from set B and two LEDs 336 from set C. Again, it is contemplated that the lamp may use more of fewer LEDs in each set.

Figure 4:
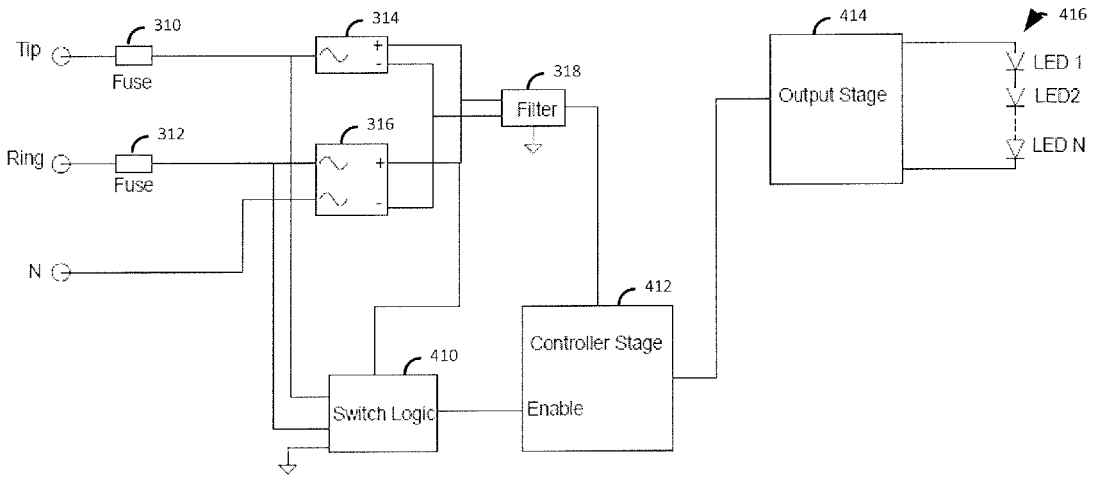
FIG. 4 is a block diagram, partly in schematic diagram form, of a second example lamp.

FIG. 4 illustrates another implementation of a solid-state lamp for a three-way luminaire. This lamp has only a single set of LEDs and is controlled by the control logic to make the three-way luminaire operate in the same way that a one-way luminaire would operate with a one-way lamp. In a three-way luminaire, the sequence of power signals is 1) ring, 2) tip, 3) ring+tip and 4) off. When a one-way lamp is used in a three-way luminaire, this sequence translates to 1) Off, 2) On, 3) On, 4) Off. This is because the one-way lamp does not have a ring contact and, thus, only turns on when power is applied to the tip contact.

The example lamp shown in FIG. 4 includes both a ring contact and a tip contact. Switch logic in the lamp, however, causes it to operate according to the sequence 1) On, 2) Off, 3) On, 4) Off. Thus, the lamp in the three-way luminaire operates in the same way as a one-way lamp in a one-way luminaire, alternating between On and Off states as the three-way switch in the luminaire is actuated.

The lamp shown in FIG. 4 includes many of the same elements as the lamp in FIG. 3 (i.e. fuses 310 and 312, power supplies 314 and 316 and filter 318). For the sake of brevity, the operation of these elements, is not described herein. The lamp shown in FIG. 4 uses different switch logic 410 that receives the input signals, tip and ring, via the fuses 310 and 312. The output signal of the switch logic 410 is a signal, Enable, which is applied to the controller stage 412. When this signal is logic-high (H), controller 412 is enabled, providing operational power to the output stage 414 to turn on the LEDs 416. When the controller is disabled, no power is provided to the output stage 414 and the LEDs 416 are turned off.

Table 2 describes the function implemented by the switch logic 410.

TABLE 2

| Tip, Ring | Enable |
|---|---|
| Off, Off | L |
| Off, On | H |
| On, Off | L |
| On, On | H |

From this table, it may be seen that the logic function may be performed using an opto-isolator (not shown) to convert the ring signal to the Enable logic signal.

As previously described, it may be desirable for both one-way and three-way solid state lamps to include circuitry that disables the lamp when a condition is detected indicating that the lamp has reached the end of its useful life. An incandescent lamp provides an essentially constant same lumen output over its lifetime. The lumen output of solid state lamps gradually decreases over the lifetime of the lamp. This may be hazardous if a lamp is used in an environment requiring a predetermined minimum lumen level. Because the luminosity of the solid state lamps decreases gradually, a person using the lamp may not notice that it has been degraded. In addition, as solid state lamps age, they become less efficient, producing more heat as they produce less light. This may be undesirable in applications where the efficiency of the lamp is important, such as lighting systems run from battery power.

The example lamps described below with reference to FIGS. 5 and 6 address these problems by disabling the solid state lamp when it is determined that the lamp has reached the end of its useful lifetime. The example lamps in FIG. 5 make this determination based on an operational characteristic of the LEDs, for example an amount of heat or light emitted by the LEDs. In the example lamps in FIG. 6 this characteristic is an amount of time that the lamp has been on or on a number of times that it has been cycled on and off.

Figure 5:
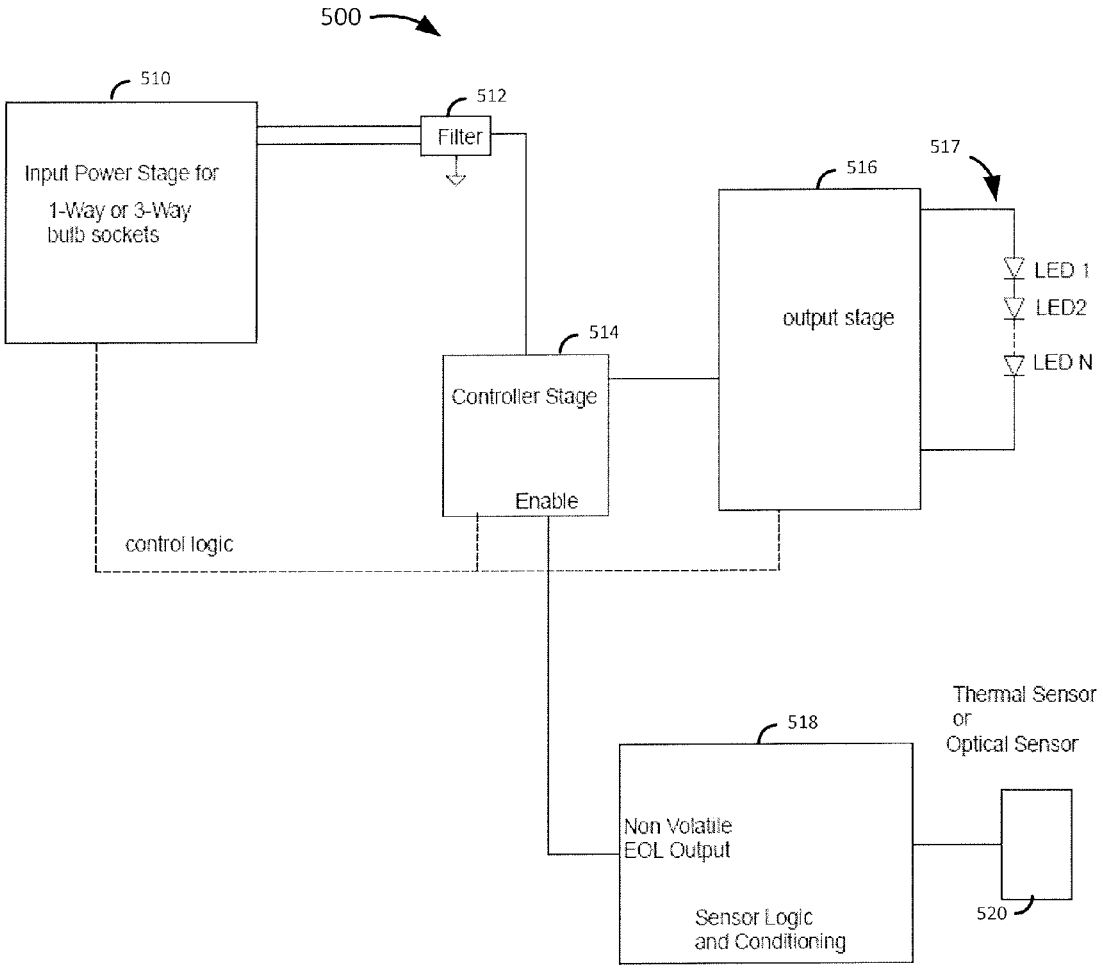
FIG. 5 is a block diagram, partly in schematic diagram form, of a third example lamp.

FIG. 5 shows an example lamp 500 having an input power stage 510 coupled to a filter 512. The input power stage may include one or more power supplies and, if the lamp is a three-way lamp, switching logic of the type described above with reference to FIGS. 3 and/or 4. The output signal provided by the power stage 510 is one or more voltage signals. The filter 512 provides a filtered output voltage signal to controller stage 514 which, in turn, provides operational power to the output stage 516 to drive the LEDs 517. As described above, the controller stage 514 reduces the voltage of the signal provided by the filter 512 to generate an operational power signal having voltage and current levels that are appropriate for the LEDs 517. The output stage applies this power signal to the LEDs 517. The combination of the input power stage 510, filter 512, controller stage 514 and output stage 516 are collectively referred to as the driver circuitry of the solid state lamp.

Both one-way and three-way lamps may benefit from lifetime monitoring. If the lamp 500 is a three-way lamp, there may be control signals generated by control logic (not shown) implemented in the input power stage 510. These optional control signals are shown by the dashed line from the input power stage 510 to the controller stage 514 and output stage 510 as described above with reference to FIGS. 3 and 4, for example.

The controller stage 514 in the lamp 500 receives an Enable signal from sensor logic and conditioning circuitry 518. The circuitry 518 is coupled to a sensor 520. In one implementation, the sensor 520 includes a thermal sensor which is coupled to the LEDs 517. In another implementation, it includes an optical sensor that is configured to measure the light provided by the LEDs 517. In yet another implementation, the sensor 520 includes both optical and temperature sensors. In the example lamps shown in FIG. 5, the Enable signal applied to the controller state 514 is a non-volatile signal indicating that the lamp has reached its end of life (EOL). The Enable signal may be, for example, a logic-high signal while the lamp is performing within its specifications and a logic-low signal otherwise. The logic-low signal may be generated by elements of the sensor logic and conditioning circuitry that short the signal to ground, causing the Enable signal to transition from logic high to ground potential (e.g. logic low), and remains at ground potential.

As described in the above-referenced published patent application, solid state lamps typically include heat dissipation elements that prevent the solid state light emitters from being damaged by excessive heat. In addition, as described above, the solid state emitters may become less efficient as they age, generating more heat and less light. One implementation of a thermal sensor may thermally couple a temperature sensor, for example a thermocouple or thermistor, to one or more of the LEDs 517. This implementation may generate the signal disabling the controller 514 when the sensed temperature is greater than a threshold value. This type of sensor may also be useful for preventing the LEDs from being damaged in normal operation when the lamp is used in an environment when the heat dissipation elements are not effective at removing heat. In this usage, however, the disable signal may not be permanent but may re-enable the lamp when the measured temperature falls below the threshold value.

Because the lamp may be operated in environments having different heat profiles, absolute temperature may not be a good measure of lamp lifetime. One alternative may be to measure differential temperature, for example when the LEDs 517 are cycled between Off and On states. An LED at the beginning of its lifetime has a different temperature profile than an LED near the end of its lifetime. For example, as it approaches the end of its useful life, the LED may heat up quickly to a higher temperature. The sensor logic and conditioning circuitry 518 may include differentiating circuitry that measures the rate of increase of the temperature and disables the controller stage 514 when the measured rate exceeds a threshold.

In a three-way lamp, it may be desirable to include multiple thermal sensors 520, one for each set of LEDs. In this implementation, the Enable signal provided to the controller stage may be a two-bit signal indicating which set of LEDs should be disabled. The operation of this implementation would be similar to an incandescent three-way lamp in which one filament can fail but the lamp continues to provide light from another filament.

In an alternative implementation, the sensor 520 may be an optical sensor rather than a thermal sensor. The optical sensor may be positioned in the lamp to receive light from the LEDs 517. In one implementation, the lamp may include an extra LED that is not used for light generation but, instead, is coupled directly to the light sensor 520. In another implementation, the light sensor 520 may be positioned in the lamp to measure the light emitted by one or more of the LEDs in their normal operation.

In this implementation, the sensor logic and conditioning circuitry 518 may compare the measured light level to a threshold value and generate the EOL output signal to disable the controller stage 514 when the measured light level is less than the threshold value.

In yet another implementation, the lamp may include both thermal and optical sensors. In this implementation, the signals provided by the two sensors may be combined to determine whether the lamp has reached its end of life. This combination may include disabling the lamp if either sensor indicates an end of life condition or only if both sensors indicate the end of life condition.

The threshold values of the operational characteristic indicating an end of life condition may be empirically derived from test data for a statistically significant number of lamps. Alternatively, the temperature and luminosity thresholds may be based on manufacturer's specifications for the LEDs 517. Determination of the threshold values may also take into account changes in the sensors due to time and environmental conditions. Also, because there may be some variation in the sensed values from sensor to sensor, it may be desirable for the sensor logic and conditioning circuitry to initially calibrate the sensor or to take predictable sensor variation into account when comparing the sensor values to the threshold values.

Figure 6:
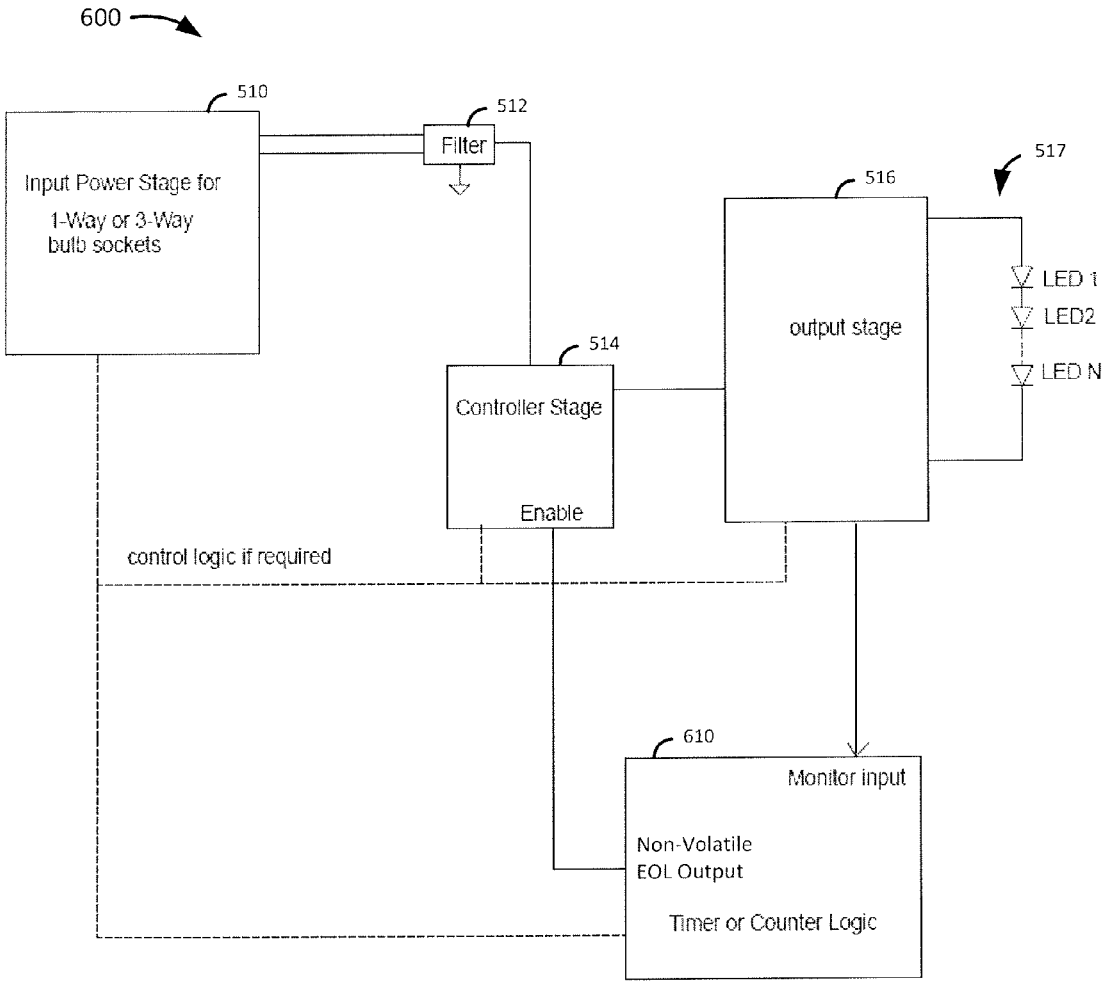
FIG. 6 is a block diagram, partly in schematic diagram form, of a fourth example lamp.

FIG. 6 shows another lamp configuration to handle LED end of life issues. The embodiments shown in FIG. 6 disable the lamp based on a total amount of time that the LEDs have been in the on state or number of on-off cycles. Although these are shown as separate embodiments, it is contemplated that they may be combined with the end-of-life detection circuitry described above with reference to FIG. 5.

The implementations shown in FIG. 6 share many of the elements of the implementations shown in FIG. 5. Accordingly, these elements are not discussed here. The key difference between the embodiments shown in FIG. 6 and that shown in FIG. 5 is the timer or counter logic 610. In a first example, the circuitry 610 includes a timer responsive to a clock signal. In one implementation, the clock signal may be derived from the AC line frequency. In another embodiment it may be controlled by a tuned circuit such as an RC, RL or LC tank circuit. In yet another embodiment, it may be a generated by an resonant crystal oscillator.

The timer includes a non-volatile register that is reset when the lamp is manufactured and is incremented at a predetermine rate, for example, once per second or once per minute, while the lamp is turned on. This register may, for example, employ a sufficient number of flash memory cells to hold a Boolean value that is greater than the expected lifetime of the lamp. The circuitry 610 may also include control circuitry that writes new values into the flash memory cells. The circuitry 610 may be configured to use the flash memory cells as the timer register or to use a separate timer register that is loaded from the flash memory when the lamp is turned on and stored back into the flash memory when the lamp is turned off. The circuitry 610 may include a small capacitor to store sufficient power to complete the storage operation after the lamp has been turned off.

In this example, the circuitry 610 may also include logic that generates the EOL disable signal when the timer reaches a predetermined value. This logic may be a digital comparator that compares the timer value to an EOL time value or it may be logic circuitry, such as a multi-input AND gate, that generates the EOL disable signal when the value in the timer register is a predetermined EOL value. As in the embodiment shown in FIG. 5, the EOL disable signal is a non-volatile signal such that, once the lamp has been disabled, it cannot be re-enabled.

The circuitry 610 determines when the LEDs are turned on responsive to a monitor input from the output stage 518. This value may be a voltage drop measured across the LEDs when they are active. The circuitry 610 may also determine when the LEDs are turned on based on output signals provided by control logic (not shown) internal to the input power stage 512. As described above with reference to FIG. 5, in a lamp configuration having multiple LED sets, such as shown in FIG. 3, it may be desirable to maintain separate timers for each LED set and selectively disable each set based on its usage time. Alternatively, the circuitry 610 may maintain a single timer that records the amount of time that any LED set is turned on and disables the lamp when a predetermined time value is exceeded.

The predetermined time value(s) are generated based on empirical lifetime data collected from a statistically significant number of lamps.

In another example implementation, the circuitry 610 does not measure an amount of time that the LEDs have been turned on but the number of times that they have been cycled from an off state to an on state. To implement this function, the circuitry may be configured to generate a delayed pulse signal when the lamp is turned on. This signal may be generated, for example, using an RC ramp circuit and a threshold comparator. When the lamp is turned on, the counter is powered up in time to count the delayed pulse signal. The count value is stored in a non-volatile register which may include a number of flash memory cells sufficient to hole a count of off-on cycles greater than the expected lifetime of the LEDs. When this count value is greater than a predetermined maximum count value, the circuitry 610 generates an EOL disable signal to disable the lamp.

In the examples described above, with reference to FIGS. 5 and 6 the lamp may be a three-way lamp and power is applied to different sets of LEDs based on the AC power being detected on the ring line, the tip line and the tip and ring lines. In these implementations, when one of the sets of LEDs is permanently disabled, the switch logic of the driver circuitry, for example the switch logic 320, shown in FIG. 3, may detect the disabled set of LEDs and change its operation to be the operation of the switch logic 410, shown in FIG. 4. Thus, the remaining sets of LEDs are turned on when power is detected on the ring line but not on the tip line and when power is detected on both the tip and ring lines and are turned off when power is detected on the tip line but not on the ring line. This effectively converts the lamp to a one-way lamp alternating between ON and OFF states as the three-way switch is operated.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," "includes," "including," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

Unless otherwise stated, any and all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present concepts.

What is claimed is:

1. A lamp, comprising:

a bulb;

a solid state source comprising a plurality of light emitting diodes (LEDs), configured to cause the lamp to emit a visible light output via the bulb, the plurality of light emitting diodes (LEDs) being configured such that:

at least one of the LEDs being configured as a first controllable channel for producing light of a first substantially white color characteristic; and at least one of the LEDs being configured as a second channel independently controllable from the first channel and configured for producing light of a second color characteristic different from the first substantially white color characteristic;

a lighting industry standard lamp base, including connectors arranged in a standard three-way lamp configuration, for providing electricity from a three-way lamp socket wherein the connectors include respective tip, ring and neutral connectors;

a housing supporting the bulb in a position to receive light from the solid state source, the housing being mechanically connected to the lamp base; and circuitry supported by the housing connected to receive electricity from the connectors of the lamp base as standard three-way control setting inputs, the circuitry including components connected to the connectors to provide direct current (DC) operational power to other components of the circuitry when alternating current (AC) power is applied to at least one of the tip and ring connectors relative to the neutral connector;

wherein the circuitry is configured to:

provide the DC power to the first controllable channel but not to the second controllable channel when AC power is applied to between the ring connector and the neutral connector and not between the tip connector and the neutral connector and to provide the power to the second controllable channel but not to the first controllable channel when AC power is applied between the tip connector and the neutral connector and not between the ring connector and the neutral connector;

detect the standard three-way control setting inputs; and adjust drive currents applied to the first and second controllable LED channels to selectively produce visible light outputs of the lamp of three different light characteristics via the bulb responsive to the three-way control setting inputs, wherein at least two of the different light characteristics differ as to color characteristics of combined white light output from the lamp via the bulb.

2. The lamp of claim 1, wherein the LEDs of the channels and the circuitry are configured such that the three different light characteristics differ as to color temperatures responsive to detection of the standard three-way control setting inputs.

3. The lamp of claim 1, wherein the LEDs of the channels and the circuitry are configured such that at least two of the different light characteristics also differ as to intensity of combined white light output from the lamp via the bulb.

4. The lamp of claim 1, wherein:

the at least two different light characteristics include three different light characteristics and the plurality of LEDs includes three sets of LEDs corresponding respectively to the first and second controllable channels and to a third controllable channel, each set of LEDs produces light exhibiting a respective one of the three different light characteristics, and each set of LEDs is configured to be turned on responsive to a respective one of the three-way control setting inputs.

5. The lamp of claim 4, wherein:

the LEDs in each of the three sets of LEDs include light emitters emitting light having a wavelength between 380 nm and 460 nm and a phosphor that converts the emitted light into white light, the phosphor in the LEDs of the first set convert the emissions to white light at a first color temperature, the phosphor in the LEDs of the second set convert the emissions to white light at a second color temperature, greater than the first color temperature, and the phosphor in the LEDs of the third set convert the emissions to white light at a third color temperature, greater than the second color temperature.

6. The lamp of claim 4, wherein the three sets of LEDs include respectively different numbers of LEDs.

7. The lamp of claim 4, wherein each of the three sets of LEDs includes the same number of LEDs.

8. The lamp of claim 4, wherein at least one of the three sets of LEDs is configured to emit light having a different color than light emitted by the other two sets of LEDs.

9. The lamp of claim 1, wherein:

at least one of the LEDs is configured as a third controllable channel independently controllable from the first and second channels for producing light of a third color characteristic different from the respective color characteristics of the first and second channels; and the circuitry is further configured to provide the DC power to the third controllable channel when AC power is applied between both the neutral connector and both the tip connector and the ring connector.

10. A lamp, comprising:

a bulb;

a solid state source comprising first, second and third sets of light emitting diodes (LEDs), configured to cause the lamp to emit a visible light output via the bulb;

a lighting industry standard lamp base, including connectors arranged in a standard three-way lamp configuration, for providing electricity from a three-way lamp socket;

a housing supporting the bulb in a position to receive light from the solid state source, the housing being mechanically connected to the lamp base; and circuitry in the housing connected to receive electricity from the connectors of the lamp base as standard three-way control setting inputs, wherein the circuitry is configured to:

detect the standard three-way control setting inputs; and to control drive current applied to the solid state light source in a sequence to toggle the respective first, second and third sets of LEDs consecutively between an OFF state and ON state.

11. A lighting device, comprising:

a solid state source comprising a plurality of light emitting diodes (LEDs), configured to cause the device to emit a visible light output;

a drive circuit to supply current to drive the LEDs; and a controller coupled to the drive circuit configured to:

measure an operational parameter of the LEDs; and upon the measured operational parameter of the lighting device reaching a threshold value related to a planned usage lifetime for the lighting device, permanently disabling the lighting device to prevent further operation.

12. The lighting device of claim 11, further comprising:

a temperature sensor, thermally coupled to at least one of the LEDs, wherein the threshold value is a temperature threshold value and the controller is configured to permanently disable the lighting device when the temperature sensor measures a temperature greater than the temperature threshold value.

13. The lighting device of claim 11, further comprising:

a temperature sensor, thermally coupled to the LEDs, wherein the threshold value is a temperature rate of change threshold value and the controller includes circuitry to measure a rate of change of temperature values provided by the temperature sensor and to permanently disable the lighting device when the measured rate of change is greater than the temperature rate of change threshold value.

14. The lighting device of claim 11, further comprising:

a light sensor, configured to measure light emitted by at least one of the LEDs, wherein the threshold value is a light threshold value and the controller is configured to permanently disable the lighting device when the measured light emitted by the at least one LED is less than the light threshold value.

15. The lighting device of claim 14, wherein the light sensor is optically coupled to one of the plurality of LEDs to receive light from the one of the LEDs.

16. The lighting device of claim 11, further comprising:

a light sensor, configured to measure light emitted by at least one of the LEDs; and a temperature sensor thermally coupled to the LEDs, wherein:

the threshold value includes a light threshold value and a temperature threshold value, and the controller is configured to permanently disable the lighting device when the measured light emitted by the at least one LED is less than the light threshold value and the temperature value provided by the temperature sensor is greater than the temperature threshold value.

17. The light emitting device of claim 11, wherein:

the plurality of LEDs includes first and second sets of LEDs, and the controller is configured to separately measure the operational characteristic of each of the first and second sets of LEDs and to separately permanently disable each set of LEDs responsive to the respective operational characteristic of the set of LEDs reaching the threshold value.

18. The light emitting device of claim 11, further including:

a bulb;

a solid state source comprising a plurality of light emitting diodes (LEDs), configured to cause the lamp to emit a visible light output via the bulb;

a lighting industry standard lamp base, including connectors arranged in a standard three-way lamp configuration, for providing electricity from a three-way lamp socket;

a housing supporting the bulb in a position to receive light from the solid state source, the housing being mechanically connected to the lamp base;

wherein:

the drive circuitry is supported by the housing and connected to receive electricity from the connectors of the lamp base as standard three-way control setting inputs, wherein the drive circuitry is configured to:

detect the standard three-way control setting inputs;

detect when one of the first and second sets of LEDs is permanently disabled and the other one of the first and second sets of LEDs is not permanently disabled;

control drive current applied to the other set of LEDs in a sequence to toggle the other set of LEDs consecutively between an OFF state and ON state, responsive to successive ones of the standard three-way control setting inputs.

19. The lighting device of claim 11, further comprising a timer circuit configured to measure an amount of time that the LEDs are emitting light as the operational characteristic of the lighting device.

20. The light emitting device of claim 19, wherein:

the plurality of LEDs includes first and second sets of LEDs;

the timer is configured to measure the amount of time the first set of LEDs is emitting light;

the lighting device includes a further timer, configured to measure a further amount of time that the second set of LEDs is emitting light;

and the controller is configured to separately permanently disable the first set of LEDs upon the measured amount of time reaching the threshold value and to separately permanently disable the second set of LEDs upon the further measured amount of time reaching the threshold value.

21. The lighting device of claim 11, further comprising:

a counter circuit configured to increment a count value each time the lighting device transitions from an off state to an on state, wherein the count value is the operational characteristic of the lighting device.

22. The light emitting device of claim 21, wherein:

the plurality of LEDs includes first and second sets of LEDs;

the counter is configured to increment the count value each time the first set of LEDs transitions from the off state to the on state;

the lighting device includes a further counter, configured to increment a further count value each time that the second set of LEDs transitions from the off state to the on state; and the controller is configured to separately permanently disable the first set of LEDs upon the count value reaching the threshold value and to separately permanently disable the second set of LEDs upon the further count value reaching the threshold value.

* * * * *